US006918139B2

(12) United States Patent
Okot

(10) Patent No.: US 6,918,139 B2
(45) Date of Patent: Jul. 19, 2005

(54) ARTICLE OF HEADWEAR HAVING A STRETCHABLE CONFIGURATION

(75) Inventor: Alex Washington Okot, Amsterdam (NL)

(73) Assignee: Nike, Inc., Beaverton, OR (US)

( * ) Notice: Subject to any disclaimer, the term of this patent is extended or adjusted under 35 U.S.C. 154(b) by 262 days.

(21) Appl. No.: 10/430,126

(22) Filed: May 5, 2003

(65) Prior Publication Data

US 2004/0221368 A1 Nov. 11, 2004

(51) Int. Cl.[7] ..... A42B 1/00
(52) U.S. Cl. ..... 2/195.3; 2/183
(58) Field of Search ..... 2/183, 195.1, 195.2, 2/195.3

(56) References Cited

U.S. PATENT DOCUMENTS

| | | | | | |
|---|---|---|---|---|---|
| 1,511,129 | A | | 10/1924 | McKnight | |
| 1,674,361 | A | | 6/1928 | Gstalder | |
| 2,052,123 | A | | 8/1936 | Adamson | |
| 2,377,933 | A | | 6/1945 | Glass | |
| 2,820,226 | A | | 1/1958 | Topiel et al. | |
| 3,309,713 | A | | 3/1967 | Kaufman | |
| 4,023,212 | A | * | 5/1977 | Huffman | 2/195.2 |
| 4,815,148 | A | * | 3/1989 | Satterfield | 2/195.1 |
| 5,031,246 | A | | 7/1991 | Kronenberger | |
| 5,272,772 | A | * | 12/1993 | Hahn | 2/195.2 |
| 5,428,843 | A | | 7/1995 | Clowers et al. | |
| 5,488,740 | A | | 2/1996 | Garza | |
| 5,548,845 | A | | 8/1996 | Gallup | |
| 5,615,415 | A | | 4/1997 | Beckerman | |
| 5,632,046 | A | | 5/1997 | Green et al. | |
| 5,715,540 | A | | 2/1998 | Cho | |
| 5,926,850 | A | | 7/1999 | Han | |
| 5,966,742 | A | | 10/1999 | Cunliffe | |
| 6,016,572 | A | | 1/2000 | Park | |
| 6,052,831 | A | | 4/2000 | Park | |
| 6,122,774 | A | | 9/2000 | Park | |
| 6,347,410 | B1 | | 2/2002 | Lee | |
| 6,502,245 | B1 | | 1/2003 | McBride | |
| 2002/0129438 | A1 | * | 9/2002 | Siegel | 2/183 |
| 2003/0226193 | A1 | | 12/2003 | Wang | |
| 2004/0128738 | A1 | * | 7/2004 | Park | 2/195.1 |

OTHER PUBLICATIONS

International Search Report mailed Aug. 6, 2004 In corresponding PCT case (6 pages).

* cited by examiner

*Primary Examiner*—Rodney M. Lindsey
(74) *Attorney, Agent, or Firm*—Banner & Witcoff, Ltd.

(57) ABSTRACT

An article of headwear is disclosed that is formed of a plurality of panels. At least one of the panels has an edge that includes an indentation that is stretched when securing the panels together. The stretching of the indentation pre-stretches a headband portion of the headwear, and enhances the comfort and fit of the headwear. An elastic element may also be secured to the panels and positioned within the headband to further enhance the comfort and fit of the headwear.

54 Claims, 16 Drawing Sheets

ARTICLE OF HEADWEAR HAVING A STRETCHABLE CONFIGURATION

BACKGROUND OF THE INVENTION

1. Field of the Invention

The present invention relates to apparel. The invention concerns, more particularly, headwear, such as a baseball cap, formed of shaped panels that impart a stretchable configuration to accommodate individuals with various head dimensions.

2. Description of Background Art

The primary elements of a standard baseball cap include a crown and visor. The crown is conventionally configured from multiple panels, also referred to as gore sections, that are sewn together to form a generally hemispherical, close-fitting covering for a head of a wearer. The visor extends in an outward direction from a front area of the crown to provide the face and eyes with shade. A wide range of materials, natural or synthetic, may be used to form a baseball cap.

The baseball cap was originally designed to prevent sunlight and rain from obscuring the vision of a baseball player. Like other specialized athletic equipment, the original baseball cap was used exclusively in the course of competition. For aesthetic purposes, the baseball cap included indicia and a color scheme consistent with the uniform of an individual team. As the popularity of baseball grew, however, non-athletes began wearing baseball caps to publicly display their support for a particular team.

Today, baseball caps continue to be used by baseball players, whether amateur or professional, for purposes of competition, but the popularity of the baseball cap has grown beyond baseball and the notion of identifying with a particular baseball team. Modern baseball caps often display the indicia of athletic teams from sports other than baseball. In addition, baseball caps may contain the indicia of corporations, places, philosophies, or individual people such as entertainers or athletes.

Baseball caps may be classified as either fitted or adjustable. Fitted baseball caps are generally manufactured in a wide range of sizes based upon a circumference of the head, with each size having fixed dimensions to accommodate an individual with corresponding head dimensions. Adjustable baseball caps, however, incorporate an adjustment system that permits a single baseball cap to accommodate individuals with various head dimensions. Accordingly, adjustable baseball caps may be manufactured with significantly fewer sizes than fitted baseball caps to accommodate size ranges rather than a particular size. Although adjustable baseball caps are generally more complex to manufacture than fitted baseball caps, the manufacturing efficiency of producing relatively few sizes reduces the overall cost of adjustable baseball caps in comparison with fitted baseball caps.

A baseball cap having a conventional style of adjustment system is disclosed in U.S. Pat. No. 5,272,772 to Hahn. A rear portion of the baseball cap includes a cut-out area having two overlapping straps that extend from opposite sides of the cut-out area. One of the straps includes a plurality of protrusions and the other strap includes a plurality of corresponding apertures. By varying the protrusions that are received by specific apertures, the circumference of the baseball cap is adjusted. A similar adjustment system is disclosed in U.S. Pat. No. 4,815,148 to Satterfield and incorporates portions of a hook and loop fastener that are located on opposite sides of a slit in the baseball cap.

A drawback to the baseball caps of Hahn and Satterfield relates to the aesthetic appearance of the adjustment system. The material forming the crown of fitted baseball caps extends entirely around the head. In contrast, the material forming the crown of the baseball caps of Hahn and Satterfield includes the cut-out area and slit, respectively, which breaks the continuity of the crown. Accordingly, manufacturers often incorporate an adjustment system into baseball caps that provides the appearance of a fitted baseball cap. For example, U.S. Pat. No. 6,122,774 to Park; U.S. Pat. No. 5,715,540 to Cho; and U.S. Pat. No. 5,615,415 to Beckerman each disclose adjustable baseball caps that incorporate a stretchable material. U.S. Pat. No. 5,031,246 to Kronenberger discloses an adjustable baseball cap that incorporates an inflatable bladder located within material that forms the bottom of the crown to vary the effective diameter of a headband in the crown.

SUMMARY OF THE INVENTION

The present invention is an article of headwear having a plurality of panels that form a covering and a band. The covering extends over at least a portion of a head. The band extends around at least a portion of the head, and is located adjacent an interior surface of the covering. The plurality of panels include a first panel with a first indentation that extends into an interior of the first panel. The first indentation is positioned in a portion of the first panel that forms the band, and an edge that forms the first indentation is secured to a second panel to stretch the first panel in an area of the first indentation. In order to impart the stretch, the plurality of panels may be formed from a stretchable material.

The headwear may be a baseball cap that includes a visor extending from the panels. In some embodiments of the invention, therefore, the headwear includes six panels. Two of the panels may form a front area of the headwear and may be shaped to have no indentations. Two other panels may form side portions of the headwear and may be shaped to include only one edge that has indentations. The two remaining panels may form a rear portion of the headwear and may be shaped to include indentations in two opposite edges.

The indentations may be formed by straight segments of the edges that extend into the panels, or the indentations may be formed from non-linear portions of the edges. With regard to the straight segments, the indentations may extend into the panels at an angle that is approximately 9.5 degrees, but other angles may also be utilized within the scope of the invention. In another aspect of the invention, an elastic element may be secured to portions of the panels that form the band.

Yet another aspect of the invention involves a method for manufacturing headwear. The method involves providing a first panel with a first covering portion and a first band portion. A first indentation is formed in an edge of the first band portion. A second panel with a second covering portion and a second band portion is provided. The first indention is then stretched, and the edge of the first band portion is secured to an edge of the second band portion. The first band portion and the second band portion are then folded to form a band of the headwear.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

The following discussion and accompanying figures disclose an article of headwear 10 having a stretchable configuration in accordance with the present invention. Headwear 10 is disclosed as having the structure of a baseball cap. The concepts and features of headwear 10 that are disclosed in the following discussion may, however, be applied to a wide range of headwear types to impart a stretchable configuration that accommodates individuals with various head dimensions. Accordingly, the present invention is not limited to baseball caps, but may be applied to a wide range of headwear types.

Figure 1:
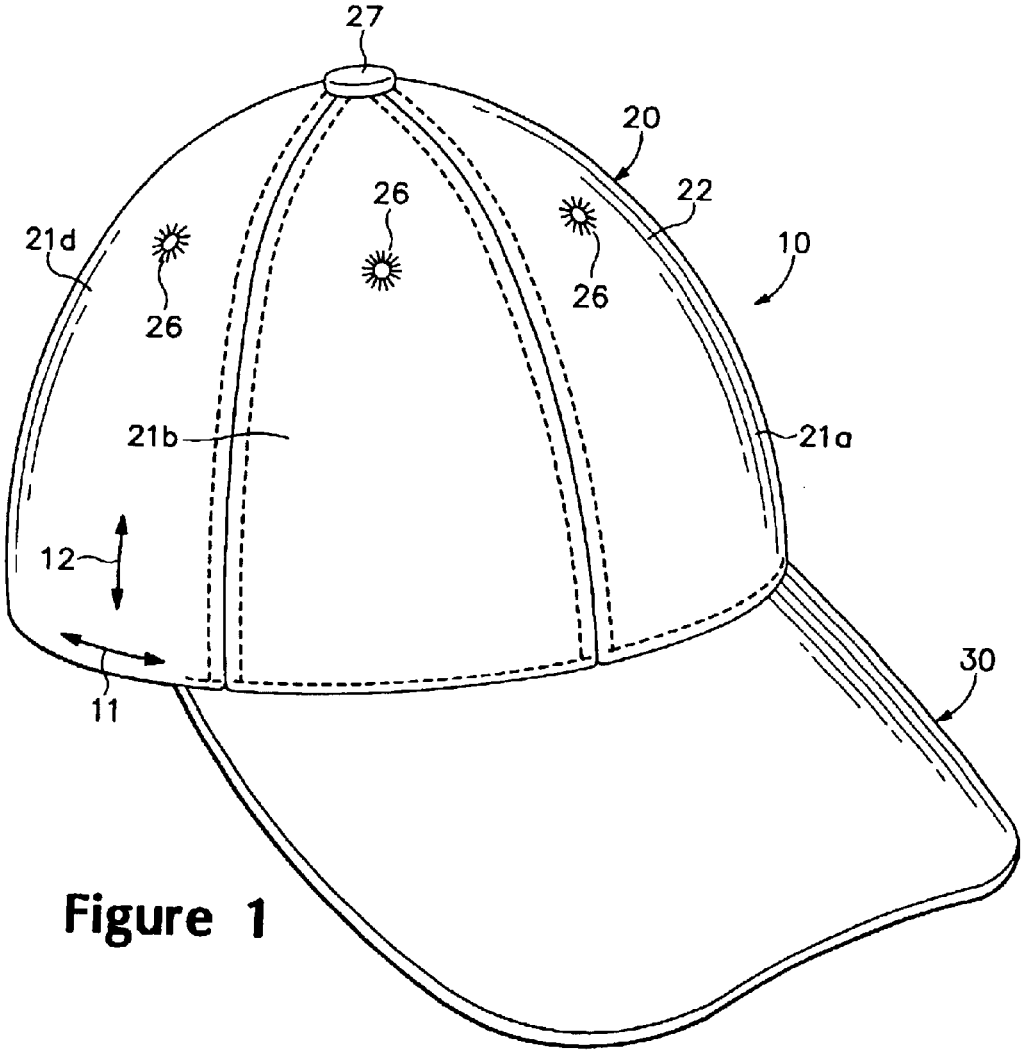
FIG. 1 is a first perspective view of an article of headwear formed in accordance with the present invention.
Figure 2:
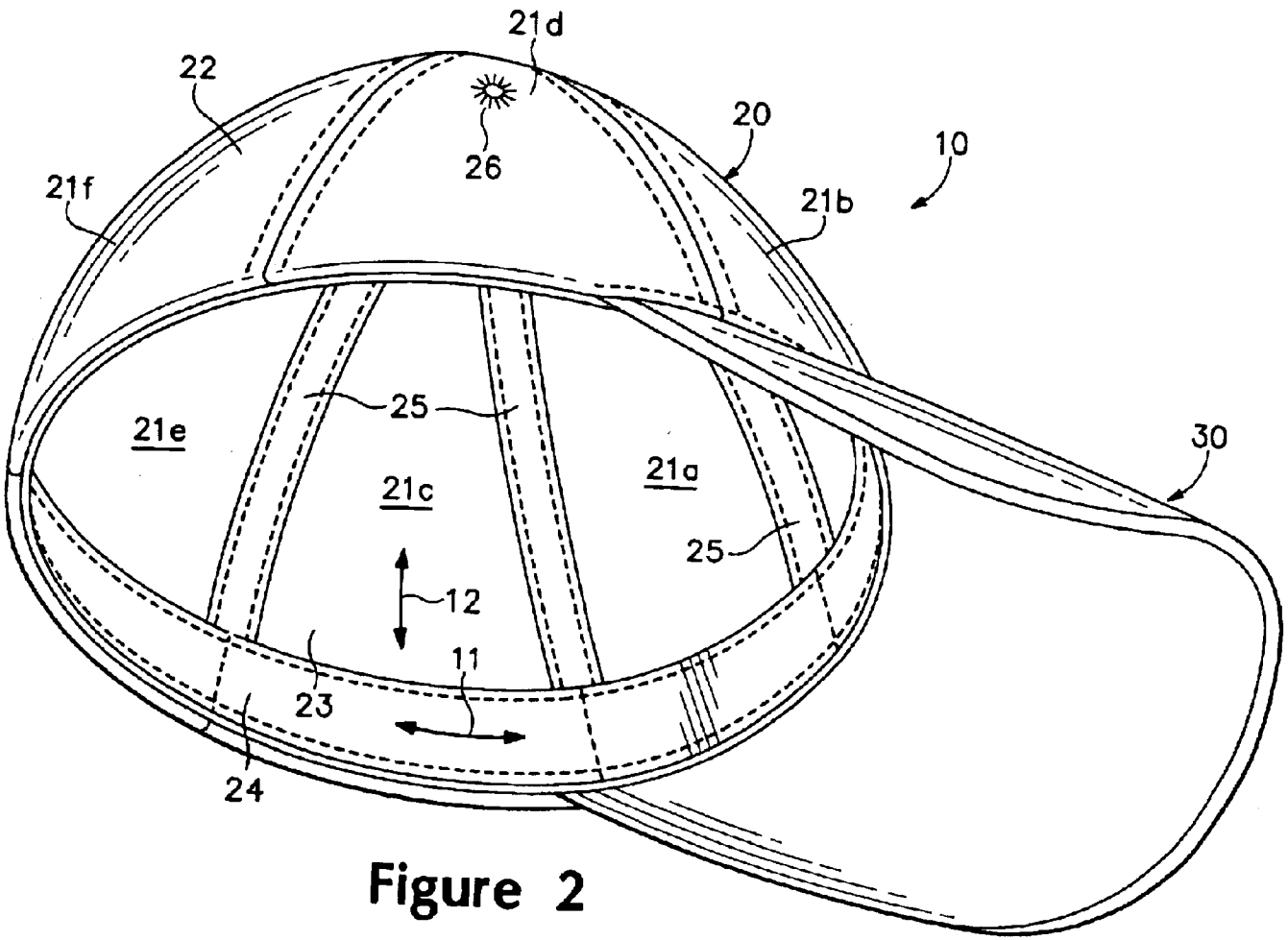
FIG. 2 is a second perspective view of the article of headwear.

Headwear 10 is depicted in FIGS. 1–2 and includes two principal elements, a crown portion 20 and a visor portion 30. Crown portion 20 forms a generally hemispherical covering for a head of an individual, and visor portion 30 extends outward in a generally horizontal direction from crown portion 20 to shade the face and eyes of an individual. The materials forming crown portion 20 extend entirely around a circumference of the head to provide headwear 10 with the appearance of a fitted baseball cap that accommodates an individual with specific head dimensions. Headwear 10, however, incorporates an adjustment system that provides a stretchable configuration to accommodate individuals with various head dimensions, as will be described in greater detail below.

Crown portion 20 includes a plurality of panels 21*a*–21*f* that are attached together along abutting sides. More specifically, crown portion 20 includes two front panels 21*a* and 21*b* that are located adjacent to visor portion 30, two side panels 21*c* and 21*d* that are located on a left side and a right side of headwear 10, respectively, and two rear panels 21*e* and 21*f* that are located in a rear area of headwear 10. The various panels 21*a*–21*f* define an exterior surface 22 and an opposite interior surface 23 of crown portion 20.

Panels 21*a*–21*f* are formed of a stretchable material that will deform in the presence of a tensile force to accommodate individuals with various head dimensions. The material forming panels 21*a*–21*f* may be any generally planar material with the ability to substantially return to an original size and shape following tensile deformation. After being stretched to a reasonable degree, therefore, the material forming panels 21*a*–21*f* is capable of substantially returning to an unstretched configuration.

Various materials are suitable for panels 21*a*–21*f*, including polymer, synthetic textile, and natural textile materials. In order to enhance the stretch properties of panels 21*a*–21*f*, the material may incorporate various elastomeric fibers, such as elastane, which is manufactured under the LYCRA trademark by E.I. duPont de Nemours and Company. Another suitable material is a stretchable cotton twill having between 2 and 5% elastane fibers. In general, suitable materials for panels 21*a*–21*f* will have a stretch that ranges at least from 2 to 5%, but the degree of stretch may vary significantly depending upon the specific structure of the various panels 21*a*–21*f* and other factors related to headwear 10.

Although head dimensions may vary in many respects, the circumference of the head is the specific head dimension that regularly determines whether a particular article of headwear is properly fitted. Accordingly, the circumference of crown portion 20 is a primary factor in determining whether headwear 10 properly fits upon a head. Referring to FIGS. 1 and 2, a first arrow 11 and a second arrow 12 are depicted for reference on crown portion 20. First arrow 11 extends in a horizontal direction and generally corresponds with a circumference of crown portion 20, whereas second arrow 12 extends in a vertical direction. By orienting the material forming panels 21*a*–21*f* such that a direction of stretch is substantially aligned with first arrow 11, crown portion 20 adjusts circumferentially to accommodate individuals with various head dimensions. That is, stretching of the material in a direction of first arrow 11 modifies the circumference of crown portion 20 in a manner that corresponds with a circumference of the head.

Panels 21*a*–21*f* may be formed from a material with one-directional stretch to provide crown portion 20 with stretch in the direction of first arrow 11. That is, the material forming panels 21*a*–21*f* may be selected to stretch in only a single direction. When manufacturing panels 21*a*–21*f* from a material with one-directional stretch, care should be taken to ensure that the direction of stretch is generally aligned with the direction of first arrow 11. Panels 21*a*–21*f* may also be formed from a material with two-directional stretch, which provides crown portion 20 with stretch along the directions of both arrows 11 and 12. One skilled in the relevant art will recognize that materials with two-directional stretch generally appear to stretch in any direction along the plane of the material. Accordingly, the directions of stretch in a material with two-directional stretch need not necessarily be aligned with arrows 11 and 12, thereby simplifying the manufacturing process of panels 21*a*–21*f*. When aligning the material relative to panels 21*a*–21*f*, the direction of greatest stretch may be aligned with first arrow 11.

Lower portions of panels 21*a*–21*f* are folded to form a band 24 that extends around the interior of crown portion 20. In further embodiments of the invention, only lower portions of panels 21*c*–21*f* may be folded to form band 24, and an additional band portion may extend under front panels 21*a* and 21*b* to form the portion of band 24 that extends under front panels 21*a* and 21*b*. In addition to panels 21*a*–21*f*, crown portion 20 may include a plurality of sections of seam tape 25, a plurality of apertures 26, and a button 27. Seam tape 25 is secured to interior surface 23 and covers various seams between panels 21*a*–21*f*. One of apertures 26 is formed in each of panels 21*a*–21*f* to enhance the transfer of air through crown portion 20. Button 26 is positioned on a top portion of crown portion 20 to mask the area where panels 21*a*–21*f* converge.

Each panel 21*a*–21*f* is formed from a planar element of material having outer boundaries that are defined by edges. Each panel 21*a*–21*f* will have a covering portion that forms the generally hemispherical shape of crown portion 20, and each panel 21*a*–21*f* has a band portion that is folded to form band 24. Specific features of each panel 21*a*–21*f* will now be discussed.

Figure 3:
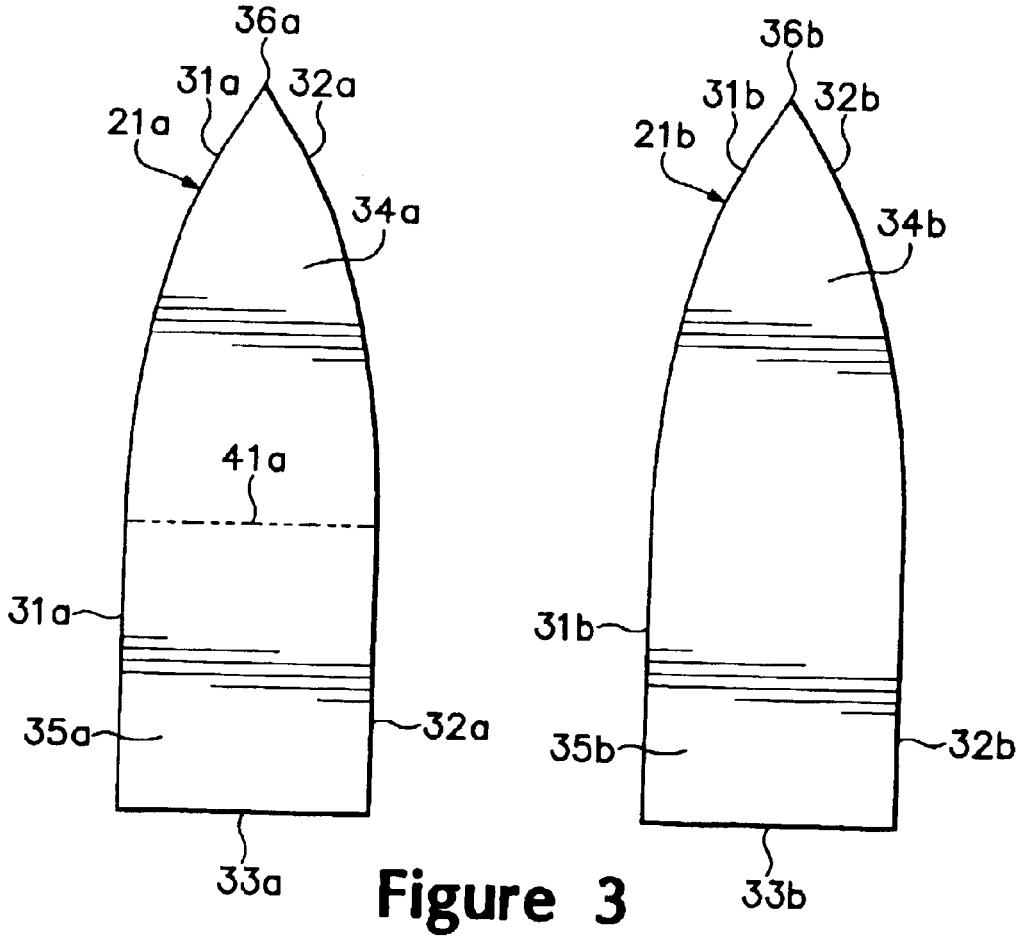
FIG. 3 is a plan view of a pair of front panels that form the headwear.

Front panels 21*a* and 21*b* are depicted individually in FIG. 3. Front panel 21*a* includes a first side edge 31*a*, an opposite second side edge 32*a*, and a base edge 33*a* that extends between side edges 31*a* and 32*a*. The area of front panel 21*a* may be divided into a covering portion 34*a* and a band portion 35*a*. For purposes of reference, a line 41*a* is depicted in FIG. 3 to delineate covering portion 34*a* from band portion 35*a*. The sections of side edges 31*a* and 32*a* that are adjacent to covering portion 34*a* have a curved configuration and form a point 36*a*. The sections of side edges 31*a* and 32*a* that are adjacent to band portion 35*a*, and base edge 33*a*, have a generally straight configuration. Furthermore, base edge 33*a* is positioned opposite covering portion 34*a*.

Front panel 21*b* has a configuration that is substantially similar to front panel 21*a*. Accordingly, front panel 21*b* includes a first side edge 31*b*, a second side edge 32*b*, and a base edge 33*b*. Furthermore, front panel 21*b* includes a covering portion 34*b* and a band portion 35*b*, and the sections of side edges 31*b* and 32*b* that are adjacent to covering portion 34*b* form a point 36*b*.

When incorporated into headwear 10, front panels 21*a* and 21*b* form the portion of crown portion 20 that is positioned above visor portion 30. More specifically, covering portions 34*a* and 34*b* form exterior surface 22 and interior surface 23 of front panels 21*a* and 21*b*, and covering portions 34*a* and 34*b* contribute to the hemispherical shape of crown portion 20. Band portions 35*a* and 35*b* have a folded configuration and form a section of band 24. Accordingly, band portions 35*a* and 35*b* extend around the portion of the interior of crown portion 20 that is adjacent to visor portion 30. Points 36*a* and 36*b* converge at a top area of crown portion 20 and are positioned under button 27.

Figure 4:
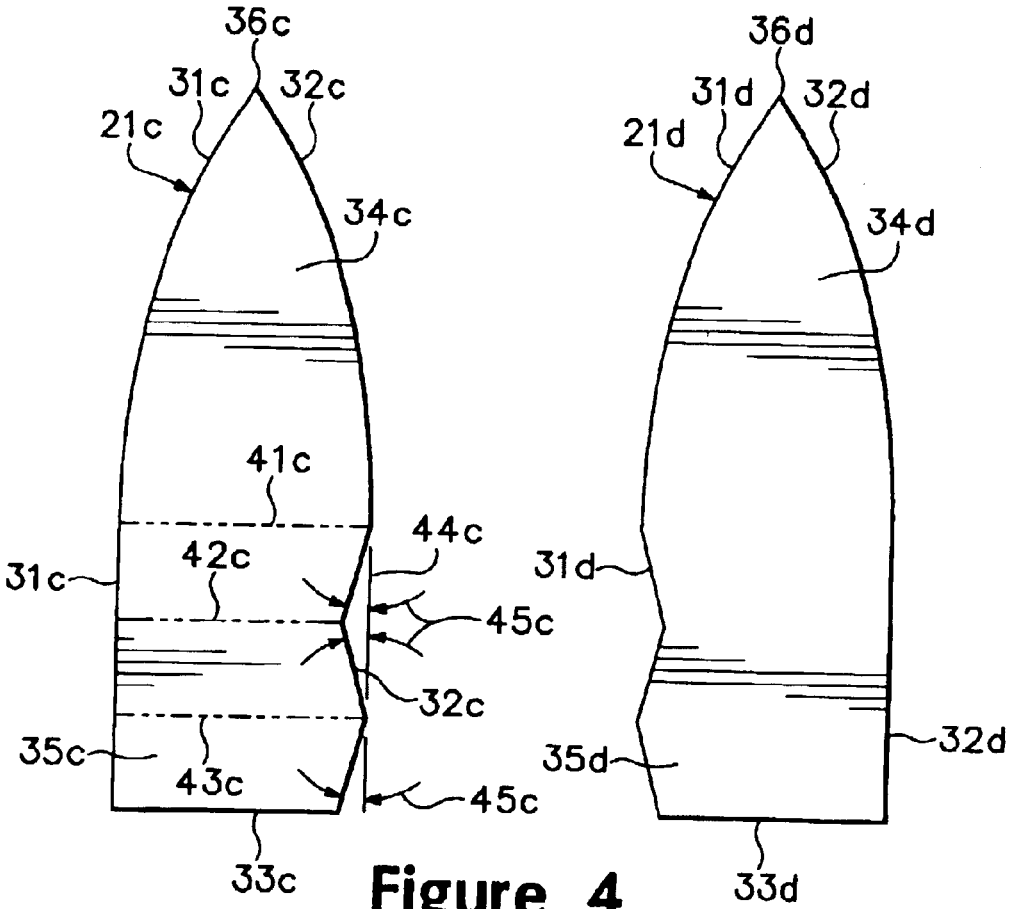
FIG. 4 is a plan view of a pair of side panels that form the headwear.

Side panels 21*c* and 21*d* are depicted individually in FIG. 4. Side panel 21*c* includes a first side edge 31*c*, an opposite second side edge 32*c*, and a base edge 33*c* that extends between side edges 31*c* and 32*c*. The area of side panel 21*c* may be divided into a covering portion 34*c* and a band portion 35*c*. For purposes of reference, a line 41*c* is depicted in FIG. 4 to delineate covering portion 34*c* from band portion 35*c*. The sections of side edges 31*c* and 32*c* that are adjacent to covering portion 34*c* have a curved configuration and form a point 36*c*. Furthermore, base edge 33*c* is positioned opposite covering portion 34*c*. The section of first side edge 31*c* that is adjacent to band portion 35*c*, and base edge 33*c*, has a generally straight configuration. In contrast, however, the section of second side edge 32*c* that is adjacent to band portion 35*c* has an indented configuration.

In comparison with front panels 21*a* and 21*b*, material is removed in the section of second side edge 32*c* to impart the indented configuration. In addition to line 41*c*, FIG. 4 depicts a line 42*c* and a line 43*c* on side panel 21*c*. In the area between line 41*c* and line 42*c*, second side edge 32*c* extends into band portion 35*c*. At line 42*c*, second side edge 32*c* alters direction and extends outward. Then, in the area between line 43*c* and base edge 33*c*, second side edge 32*c* again extends into band portion 35*c*. Accordingly, material forming side panel 21*c* is removed in the indented area between line 41*c* and 43*c*, and in the indented area between line 43*c* and base edge 33*c*. This pattern of removed material forms the indented configuration of second side edge 32*c*.

The specific angles formed by the indented configuration of second side edge 32*c* may vary considerably within the scope of the present invention. For purposes of reference, a line 44*c* is depicted in FIG. 4 and is parallel to the section of first side edge 31*c* that is adjacent to band portion 35*c*, thereby highlighting the indented configuration of second side edge 32*c*. In one embodiment of the invention, the distance between line 41*c* and base edge 33*c* is approximately 9 centimeters. Line 42*c* is spaced from line 41*c* by a distance of approximately 3 centimeters, and line 43*c* is spaced from line 41*c* by a distance of approximately 6 centimeters. Furthermore, the distance between line 44*c* and the most indented points of second side edge 32*c* is approximately 0.5 centimeters. These dimensions provide three indentation angles 45*c* that are approximately 9.5 degrees. Accordingly, second side edge 32*c* departs from line 44*c* by an angle of approximately 9.5 degrees. Within the scope of the present invention, however, indentation angles 45*c* may vary significantly, and may be in a range of 9.5 to 13 degrees, for example.

Side panel 21*d* has a configuration that is substantially similar to side panel 21*c*. Accordingly, side panel 21*d* includes a first side edge 31*d*, a second side edge 32*d*, and a base edge 33*d*. Furthermore, side panel 21*d* includes a covering portion 34*d* and a band portion 35*d*, and the sections of side edges 31*d* and 32*d* that are adjacent to covering portion 34*d* form a point 36*d*. Whereas second side edge 32*c* has the indented configuration in side panel 21*c*, first side edge 31*d* of side panel 21*d* has the indented configuration. As with second side edge 32*c*, the indentation angles formed by first side edge 31*d* may be approximately 9.5 degrees, or may vary from 9.5 to 13 degrees, for example.

When incorporated into headwear 10, side panels 21*c* and 21*d* form side portions of crown portion 20. More specifically, covering portions 34*c* and 34*d* form exterior surface 22 and interior surface 23 of side panels 21*c* and 21*d*, and covering portions 34*c* and 34*d* contribute to the hemispherical shape of crown portion 20. Band portions 35*c* and 35*d* have a folded configuration and form sections of band 24. As with points 36*a* and 36*b*, points 36*c* and 36*d* converge at the top area of crown portion 20 and are positioned under button 27.

Figure 5:
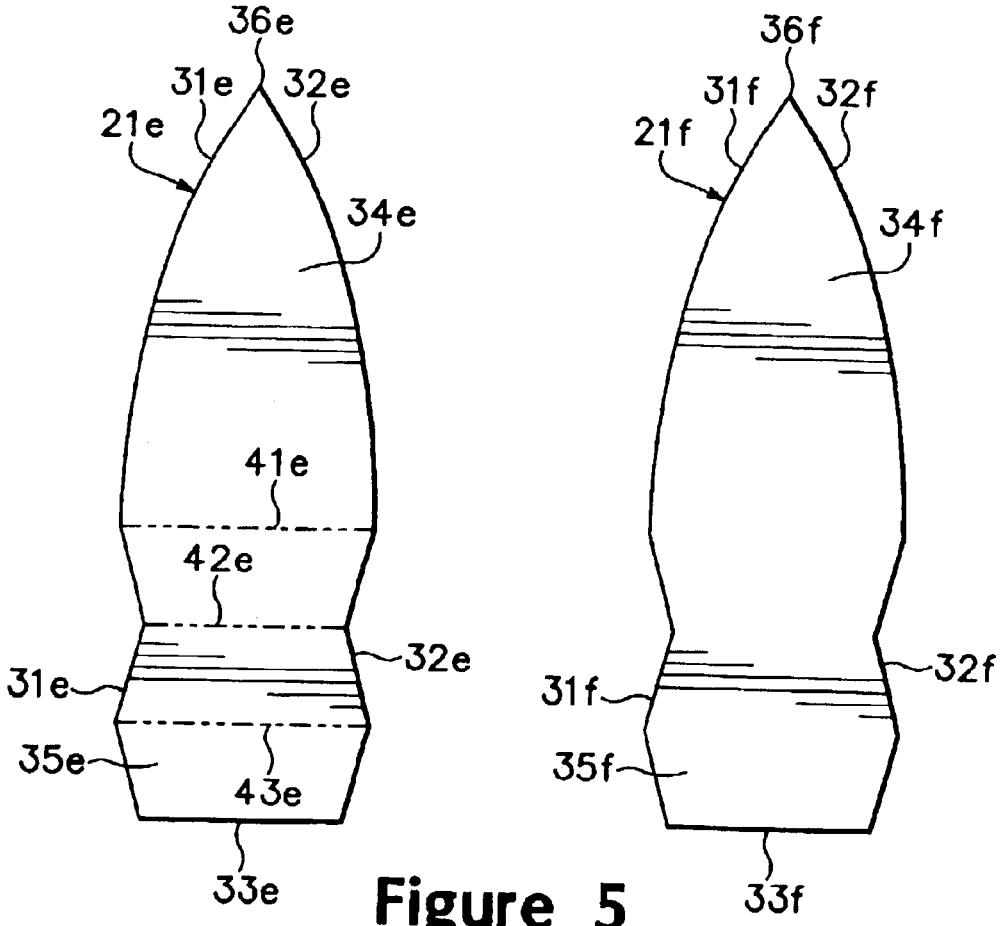
FIG. 5 is a plan view of a pair of rear panels that form the headwear.

Rear panels 21*e* and 21*f* are depicted individually in FIG. 5. Rear panel 21*e* includes a first side edge 31*e*, an opposite second side edge 32*e,* and a base edge 33*e* that extends between side edges 31*e* and 32*e.* The area of rear panel 21*e* may be divided into a covering portion 34*e* and a band portion 35*e.* For purposes of reference, a line 41*e* is depicted in FIG. 5 to delineate covering portion 34*e* from band portion 35*e.* The sections of side edges 31*e* and 32*e* that are adjacent to covering portion 34*e* have a curved configuration and form a point 36*e.* Furthermore, base edge 33*e* is positioned opposite covering portion 34*e.* In contrast with panels 21*a*–21*d,* neither the section of first side edge 31*e* that is adjacent to band portion 35*e,* nor the section of second side edge 32*e* that is adjacent to band portion 35*e* has a straight configuration. Instead, material is removed from both sides of band portion 35*e* to impart an indented configuration.

In addition to line 41*e,* FIG. 5 depicts a line 42*e* and a line 43*e* on rear panel 21*e.* In the area between line 41*e* and line 42*e,* first side edge 31*e* extends into band portion 35*e.* At line 42*e,* second first side edge 31*e* alters direction and extends outward. Then, in the area between line 43*e* and line base edge 33*e,* first side edge 31*e* again extends into band portion 35*e.* Accordingly, material forming rear panel 21*e* is removed in the indented area between line 41*e* and 43*e,* and in the indented area between line 43*e* and base edge 33*e.* This pattern of removed material forms the indented configuration of first side edge 31*e.* A similar pattern forms the indented configuration of second side edge 32*e.* As with the indented configuration of side panels 21*c* and 21*d,* the indentation angles formed by first side edge 31*e* and second side edge 32*e* may be approximately 9.5 degrees, or may vary from 9.5 to 13 degrees, for example.

Rear panel 21*f* has a configuration that is substantially similar to rear panel 21*e.* Accordingly, rear panel 21*f* includes a first side edge 31*f,* a second side edge 32*f,* and a base edge 33*f* that extends between side edges 31*f* and 32*f.* Furthermore, side panel 21*f* includes a covering portion 34*f* and a band portion 35*f,* and the sections of side edges 31*f* and 32*f* that are adjacent to covering portion 34*f* form a point 36*f.* In addition, both first side edge 31*f* and second side edge 32*f* have an indented configuration, and the indentation angles formed by first side edge 31*f* and second side edge 32*f* may be approximately 9.5 degrees, or may vary from 9.5 to 13 degrees, for example.

When incorporated into headwear 10, rear panels 21*e* and 21*f* form rear portions of crown portion 20. More specifically, covering portions 34*e* and 34*f* form exterior surface 22 and interior surface 23 of rear panels 21*e* and 21*f,* and covering portions 34*e* and 34*f* contribute to the hemispherical shape of crown portion 20. Band portions 35*e* and 35*f* have a folded configuration and form the remaining sections of band 24. Points 36*e* and 36*f* also converge at the top area of crown portion 20 and are positioned under button 27 with points 36*a*–36*d.*

The indented configuration of panels 21*c*–21*f* is achieved by removing material from base portions 35*c*–35*f,* respectively. Given the dimensions of base portion 35*c,* as provided above, the total amount of material removed from side panel 21*c* to form the indented areas is 2.25 square centimeters, and the same amount is removed from side panel 21*d*. Rear panels 21*e* and 21*f* each have twice as many indented areas as side panels 21*c* and 21*d.* Accordingly, the total amount of material removed from each of rear panels 21*e* and 21*f* to form the indented areas is 4.5 square centimeters. Overall, therefore, the total amount of material removed to form the indented areas is 13.5 square centimeters.

The specific configuration of panels 21*a*–21*f* described above is intended to provide an example of the possible configurations that may be utilized in forming headwear 10. Accordingly, numerous modifications may be made to the configuration of panels 21*a*–21*f* within the scope of the present invention. For example, the various edges that form the indented configuration of panels 21*c*–21*f* is depicted in the figures as having a plurality of segments with a straight or linear configuration that extend into panels 21*c*–21*f*. In further embodiments of the invention, the segments of the edges that form the indented configuration may be non-linear, and may have a wave-like configuration, for example. In addition, the proportions of the panels 21*a*–21*f,* the dimensions of band portions 35*a*–35*f,* the indentation angles, and the number of indentations, for example, may vary significantly.

Figure 6:
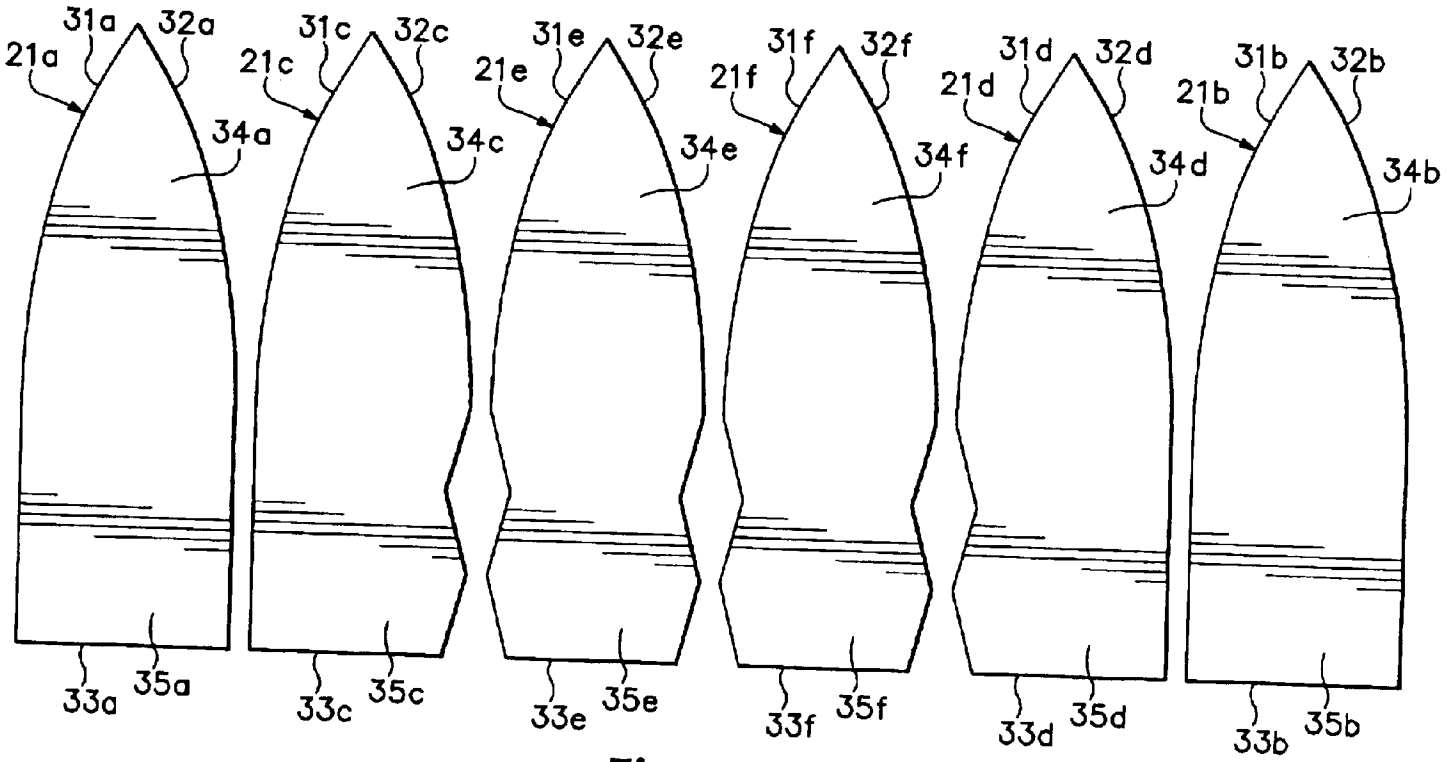
FIG. 6 is a plan view of the panels in a first stage of manufacture.

The manufacturing process of crown portion 20 will now be discussed. As a preliminary step in the manufacturing process, the various panels 21*a*–21*f* are formed, which may involve die-cutting panels 21*a*–21*f* from an element of material. When forming panels 21*a*–21*f,* the direction of stretch may be aligned so as to produce stretch in the circumferential direction of crown portion 20, which corresponds with first arrow 11. Panels 21*a*–21*f* are then arranged as depicted in FIG. 6, for example, such that the relative positions of panels 21*a*–21*f* is similar to the relative positions of panels 21*a*–21*f* in crown portion 20. That is, panel 21*a* is adjacent to panel 21*c,* panel 21*c* is also adjacent to panel 21*e,* panel 21*e* is also adjacent to panel 21*f,* etc.

Figure 7:
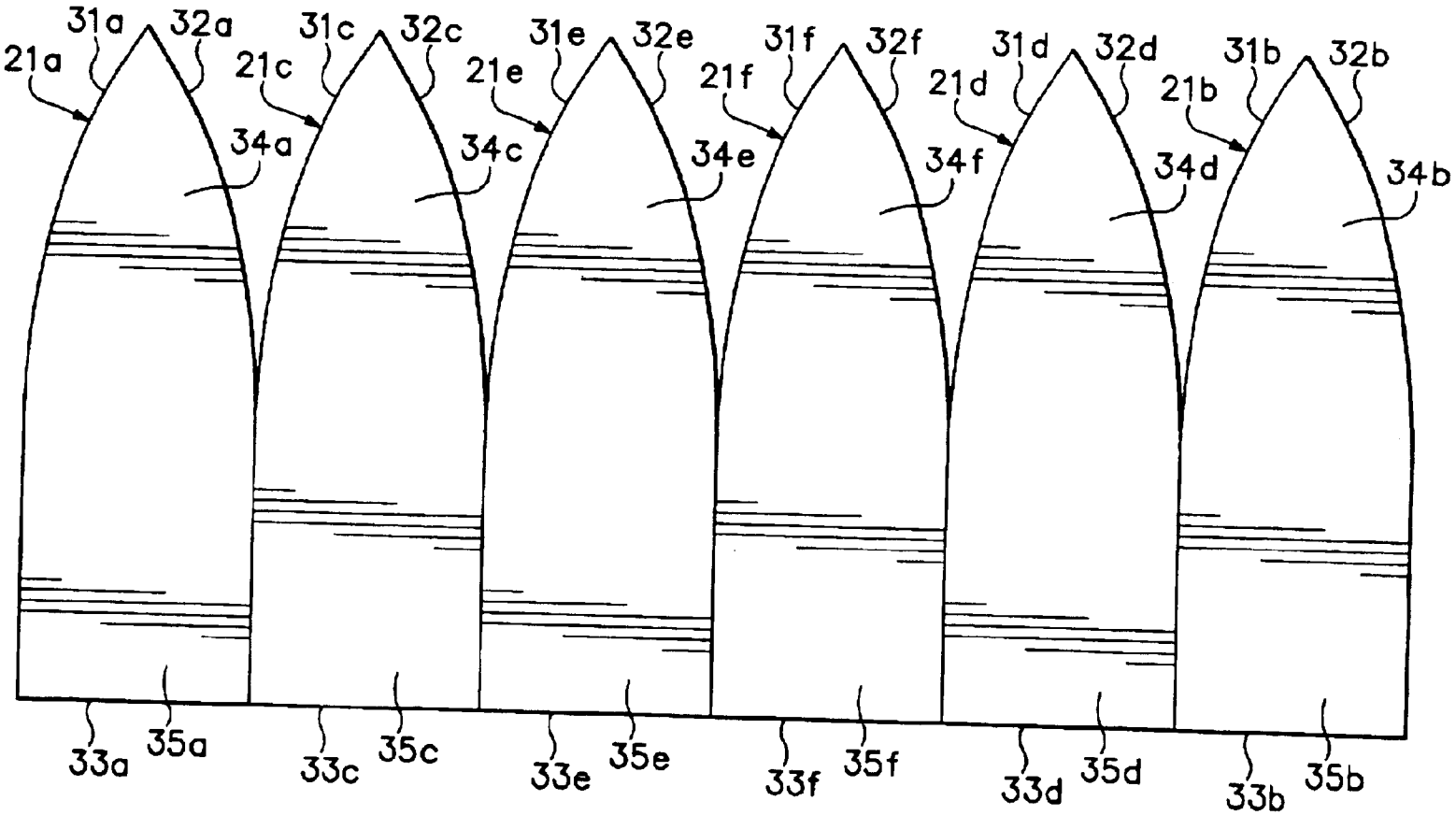
FIG. 7 is a plan view of the panels in a second stage of manufacture.

The adjacent edges of panels 21*a*–21*f* are then secured together, through stitching or adhesive bonding, for example, as depicted in FIG. 7. More particularly, the portion of second edge 32*a* adjacent to band portion 35*a* is secured to the portion of first side edge 31*c* that is adjacent to band portion 35*c;* the portion of second side edge 32*c* adjacent to band portion 35*c* is secured to the portion of first side edge 31*e* that is adjacent to band portion 35*e;* the portion of second side edge 32*e* adjacent to band portion 35*e* is secured to the portion of first side edge 31*f* that is adjacent to band portion 35*f;* etc. In securing the various edges together, the indented areas are stretched to form a generally straight line at the interface of the various panels 21*a*–21*f.* As depicted in FIG. 7, first side edge 31*a* is not secured to second side edge 32*f.* At this stage in the manufacturing process, however, first side edge 31*a* may be secured to second side edge 32*f.* Furthermore, FIG. 7 does not depict the portions of second side edges 32*a*–32*f* that are adjacent to covering portions 34*a*–34*f,* respectively, as being secured to the portions of first side edges 31*a*–31*f* that are adjacent to covering portions 34*a*–34*f,* respectively. At this stage in the manufacturing process, however, these portions of second side edges 32*a*–32*f* may also be secured to first side edges 31*a*–31*f.*

Figure 8:
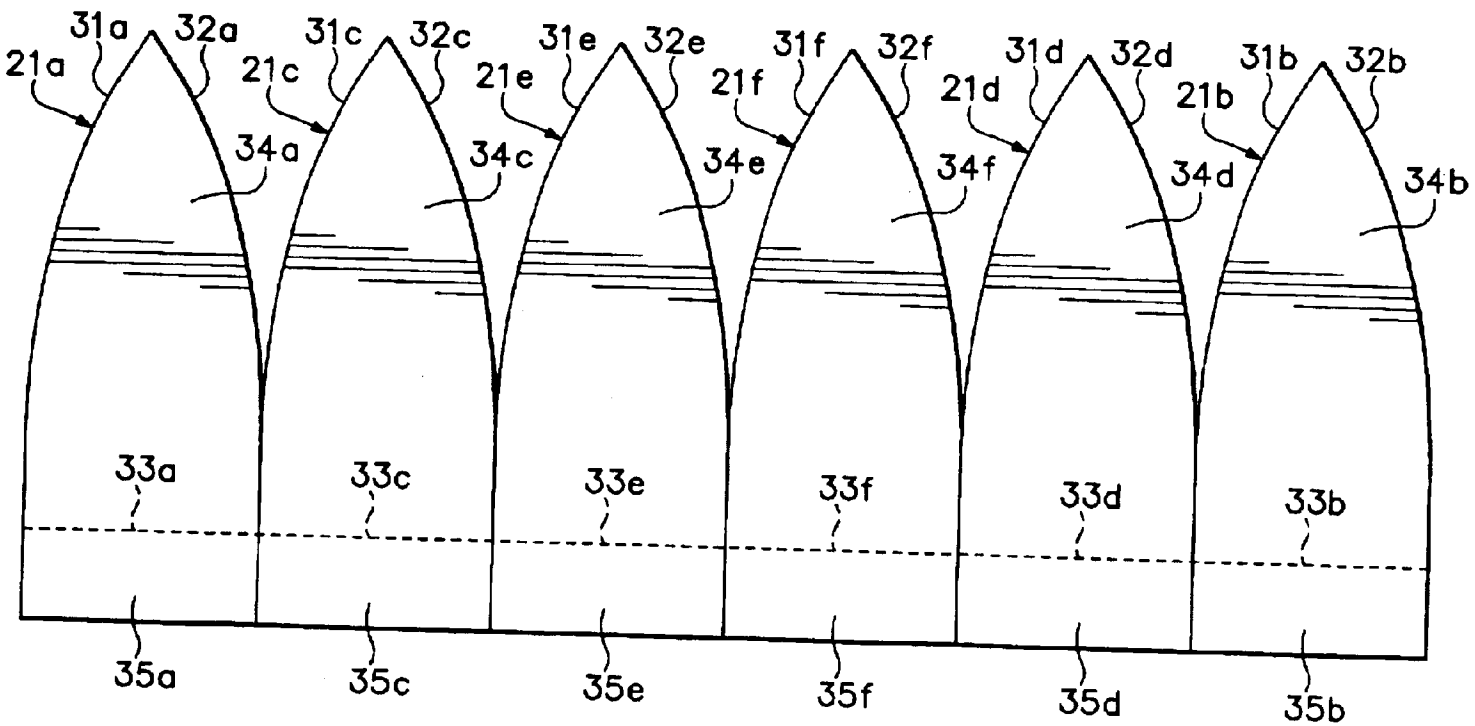
FIG. 8 is a plan view of the panels in a third stage of manufacture.
Figure 9:
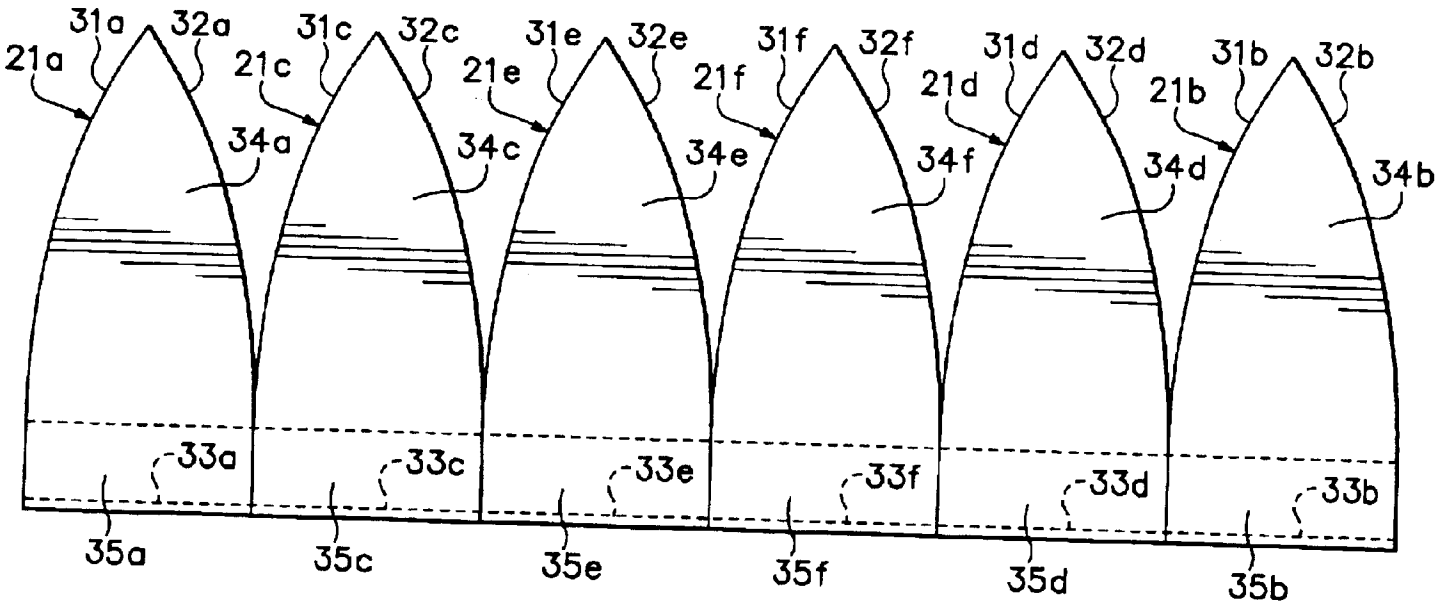
FIG. 9 is a plan view of the panels in a fourth stage of manufacture.

Once the various panels 21*a*–21*f* are secured together, base portions 35*a*–35*f* may be folded to begin the formation of band 24. As discussed above with respect to side panel 21*c,* the distance between line 41*c* and base edge 33*c* may be approximately nine centimeters. Similar dimensions are utilized for corresponding portions of other panels 21*a*–21*f.* By folding band portions 35*a*–35*f* twice, band 24 may be formed to have a width that is approximately 3 centimeters. Referring to FIG. 8, band portions 35*a*–35*f* are depicted as having a single fold. By folding band portions 35*a*–35*f* one additional time, the configuration of FIG. 9 is achieved. Accordingly, band 24 may be formed by merely folding band portions 35*a*–35*f.* Additional stitching may also be added to crown portion 20 to secure the position of band 24 and ensure that the various band portions 35*a*–35*f* do not become unfolded.

Figure 10:
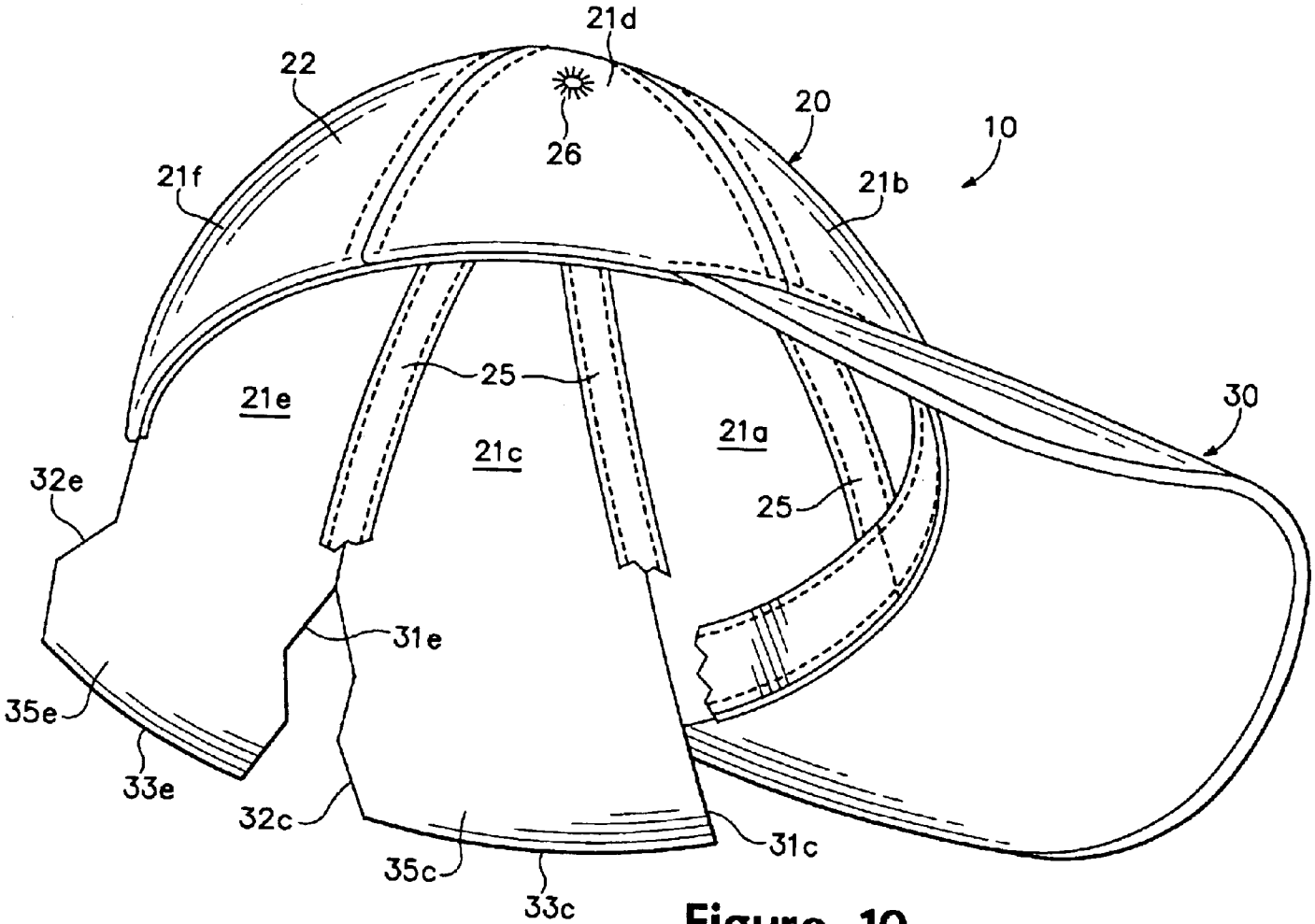
FIG. 10 is a partially-exploded perspective view of the headwear.

The manner in which band portions 35*a*–35*f* are folded to form band 24 may be further understood with respect to FIG. 10, which depicts panels 21*c* and 21*e* in a deconstructed configuration, for purposes of example. By securing each of base portion 35*c* and base portion 35*e* together and folding each of base portion 35*c* and base portion 35*e* two times, headband 24 may be formed within crown portion 20. Note, however, that FIG. 10 is not intended to show an intermediate step in the manufacturing process for headwear 10. Rather, FIG. 10 is intended to show the relative positions of various portions of headwear 10 in order to assist with understanding of the invention and the placement of the various elements.

Following the formation of band 24, first side edge 31*a* may be secured to second side edge 32*f*. Furthermore, the portions of second side edges 32*a*–32*f* that are adjacent to covering portions 34*a*–34*f*, respectively, may be secured to the portions of first side edges 31*a*–31*f* that are adjacent to covering portions 34*a*–34*f*, respectively. This forms the generally hemispherical shape of crown portion 20. Seam tape 25 may then be secured to interior surface 23 to mask the seams between the various panels 21*a*–21*f*. Apertures 26 may be formed, and button 27 may be added to the area of points 36*a*–36*f*, thereby substantially completing the manufacture of crown portion 20. Visor portion 30 may then be added in a conventional manner to substantially complete the manufacture of headwear 10.

As noted above, headwear 10 has a stretchable configuration that accommodates individuals with various head dimensions. The stretchable configuration of headwear 10 is provided by the material that forms panels 21*a*–21*f*. In general, the direction of stretch in the material that forms panels 21*a*–21*f* is substantially aligned with first arrow 11. This ensures that crown portion 20 stretches circumferentially to accommodate heads with various dimensions.

The formation of the indented areas in panels 21*a*–21*f* enhances the stretchable configuration of headwear 10. Referring back to FIG. 7, the step of securing the various panels 21*a*–21*f* to each other required that the indented areas be stretched in order to stitch the various edges together. That is, the indented areas were stretched such that the various edges would meet for purposes of stitching the edges together. The act of stretching the various panels 21*a*–21*f* induced an initial amount of stretching in crown portion 20. That is, prior to placing headwear 10 upon a head of an individual, crown portion 20 is already stretched an initial amount. The initial stretching of crown portion 20 reduces the overall additional stretch that is available in crown portion 20, which provides the individual with a more secure fit.

A stretchable cotton twill material is one suitable material for a conventional baseball cap and is also suitable for panels 21*a*–21*f*. Such a cotton twill material may be stretched approximately 9% percent prior to damaging individual filaments or fibers that form the cotton twill material. When stretching a material such as cotton twill, initial portions of the stretching will require less tensile force than later portions of stretching. That is, the tensile force required to stretch the cotton twill material will increase as the material is stretched. If an individuals requires only a few percent of stretch in the conventional crown portion, then the resistance provided by the conventional crown portion may be relatively small. The individual may find, therefore, that the conventional baseball cap fits upon the head in a manner that is too loose.

The indented configuration of panels 21*c*–21*f* serves to prestretch crown portion 20 and provide an enhanced fit. Whereas the conventional crown portion is unstretched prior to placing the conventional headwear upon the head, crown portion 20 is prestretched due to the indented configuration of panels 21*c*–21*f*. Referring back to FIG. 7, each of panels 21*c*–21*f* were stretched in order to secure adjacent edges to each other. The prestretching of crown portion 20 ensures that the material forming panels 21*c*–21*f* provides greater resistance to stretching. That is, crown portion 20 is prestretched to the point where headwear 10 provides the individual with a tighter, more secure fit.

The degree of prestretching in crown portion 20 is primarily determined by the configuration of the indented areas in panels 21*c*–21*f*. If, for example, the indentation angles are relatively small, the degree of prestretching will also be relatively small. A small degree of prestretching may produce headwear that is similar to the conventional baseball cap. If, however, the indentation angles are relatively large, the degree of prestretching will also be relatively large. A large degree of prestretching may produce headwear that does not have sufficient stretch remaining and is too tight. In designing headwear 10, therefore, a balance may be achieved by varying the indentation angles in panels 21*c*–21*f*. Accordingly, the indentations angles may be varied to produce a desired fit in headwear 10.

Figure 11:
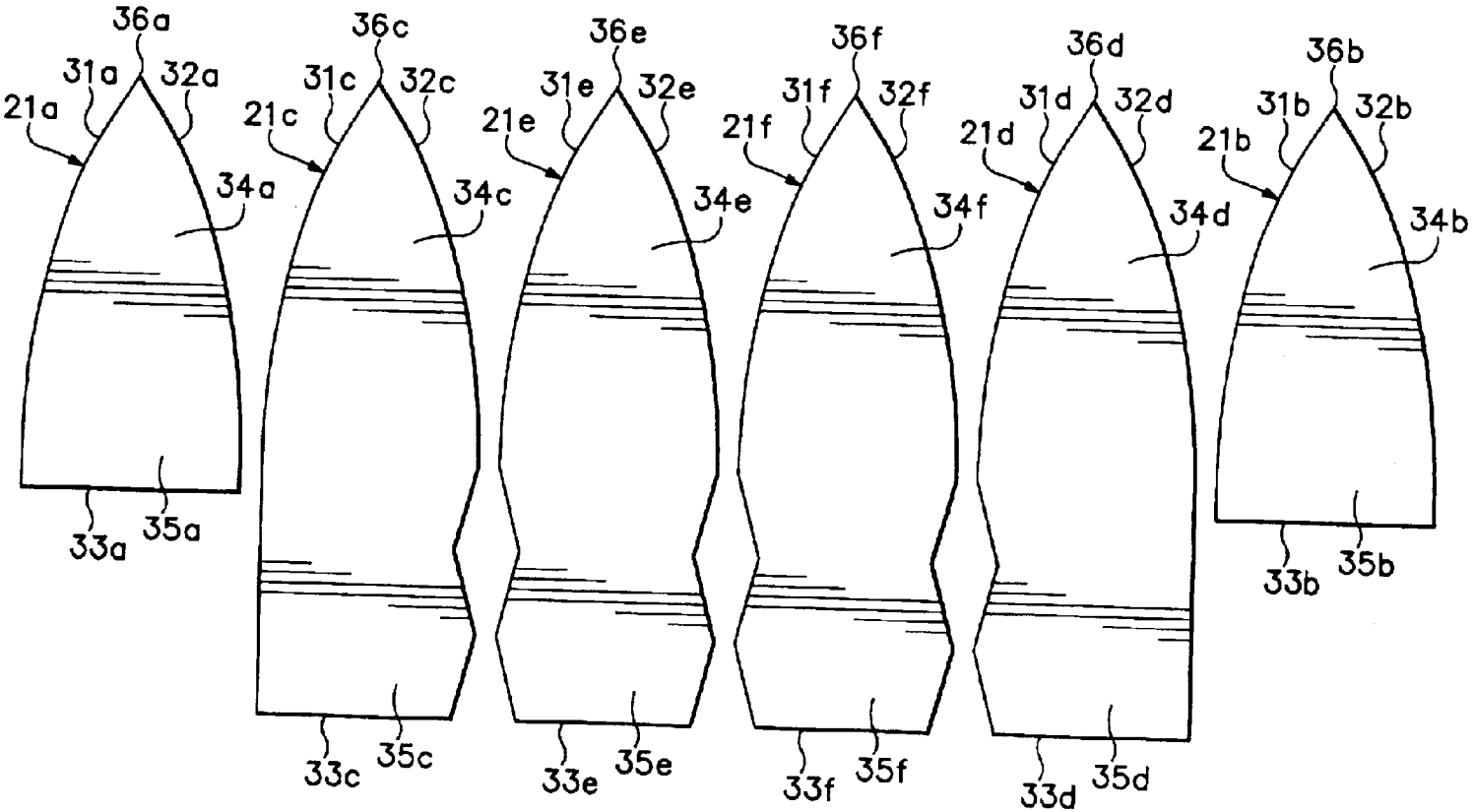
FIG. 11 is a plan view of an alternate panel configuration in a first stage of manufacture.

As an alternative to the particular configuration of headwear 10 discussed above, panels 21*a*–21*f* may have the modified configuration depicted in FIGS. 11–15. That is, front panels 21*a* and 21*b* may include band portions 35*a* and 35*b*, respectively, that are significantly reduced in size. The manufacturing process for this configuration is similar to the manufacturing process described above. Accordingly, panels 21*a*–21*f* are arranged, as depicted in FIG. 11, such that the relative positions of panels 21*a*–21*f* is similar to the relative positions of panels 21*a*–21*f* in crown portion 20. That is, panel 21*a* is adjacent to panel 21*c*, panel 21*c* is also adjacent to panel 21*e*, panel 21*e* is also adjacent to panel 21*f*, etc.

Figure 12:
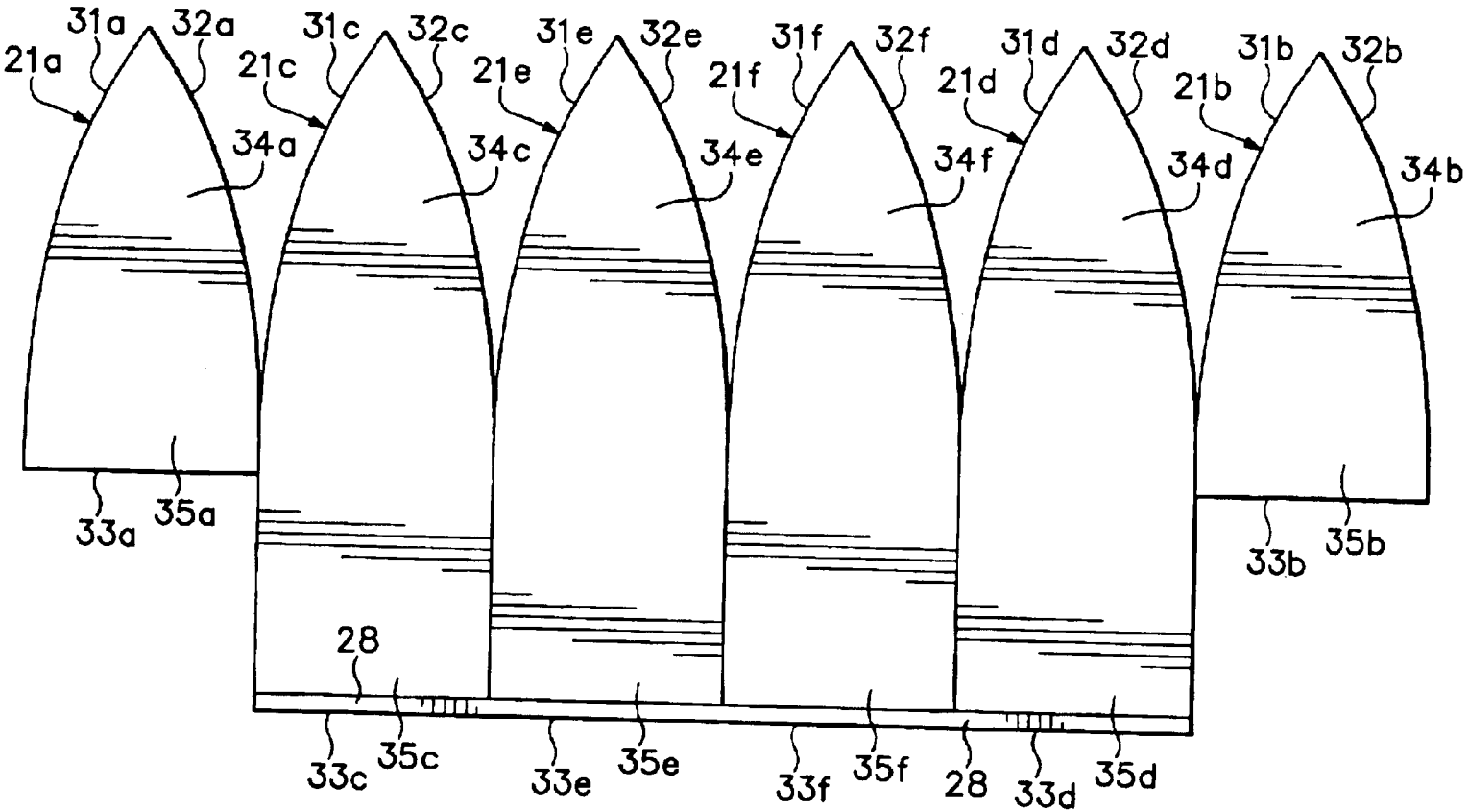
FIG. 12 is a plan view of the alternate panel configuration in a second stage of manufacture.

The adjacent edges of panels 21*a*–21*f* are then secured together, through stitching or adhesive bonding, for example, as depicted in FIG. 12. In addition, a stretchable element 28 is secured to panels 21*c*–21*f* in a position that is adjacent to base edges 33*c*–33*f*. Element 28 may be an elastic strip having a width of approximately 3 millimeters, or element 28 may be any generally elastic material that has a suitable degree of stretchability. In some embodiments of the present invention, element 28 will have a width that is less than 8 millimeters. Element 28 may be overlocked to base edges 33*c*–33*f*, for example, to incorporate element 28 into crown portion 20.

Figure 13:
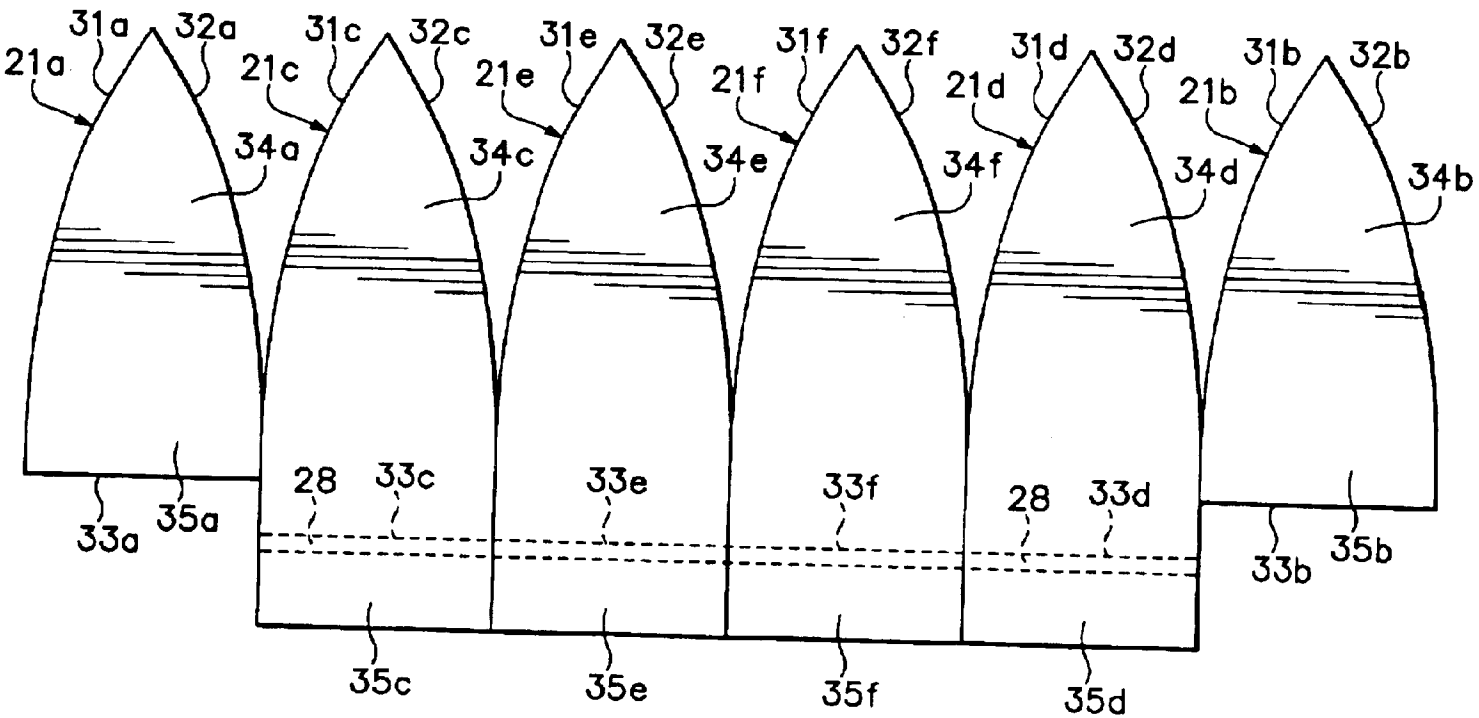
FIG. 13 is a plan view of the alternate panel configuration in a third stage of manufacture.
Figure 14:
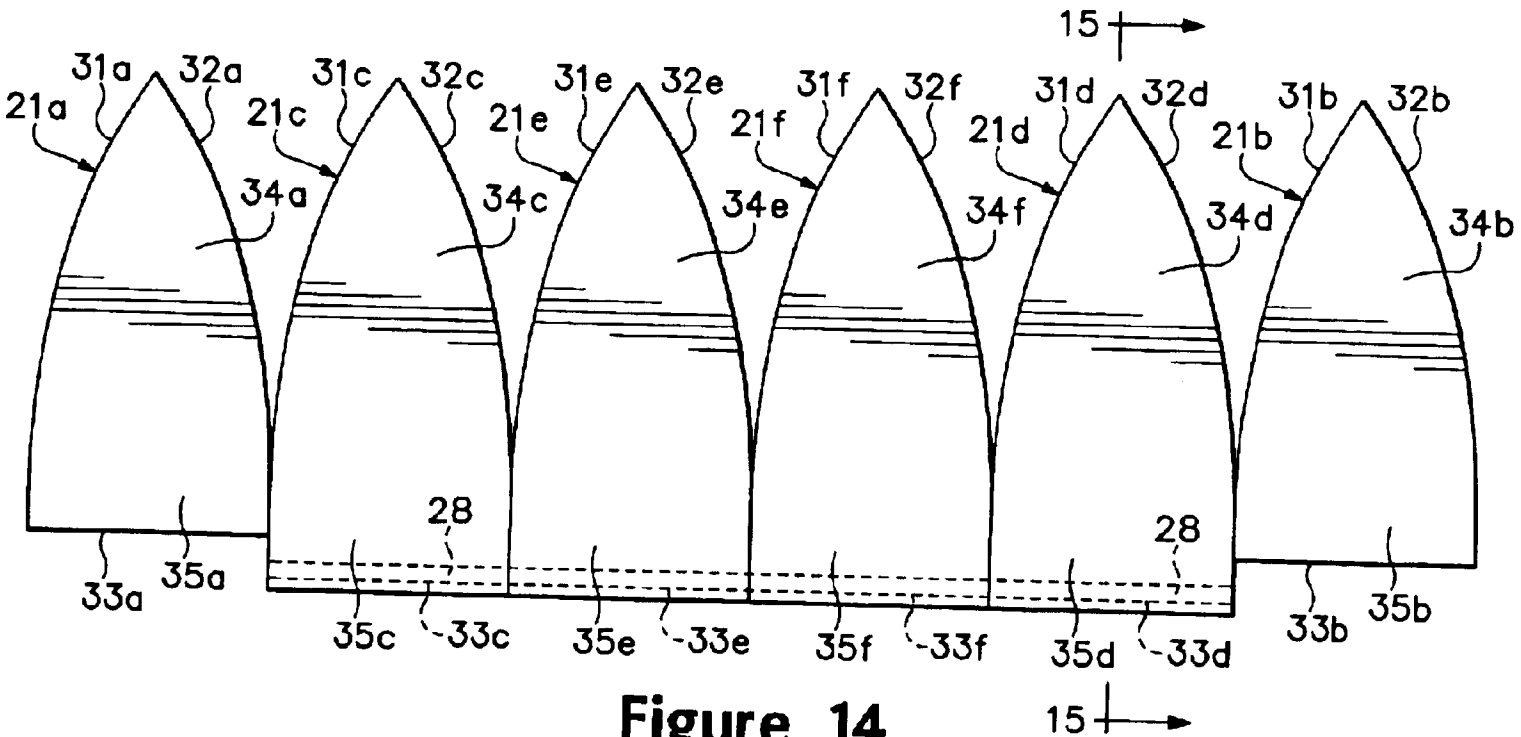
FIG. 14 is a plan view of the alternate panel configuration in a fourth stage of manufacture.
Figure 15:
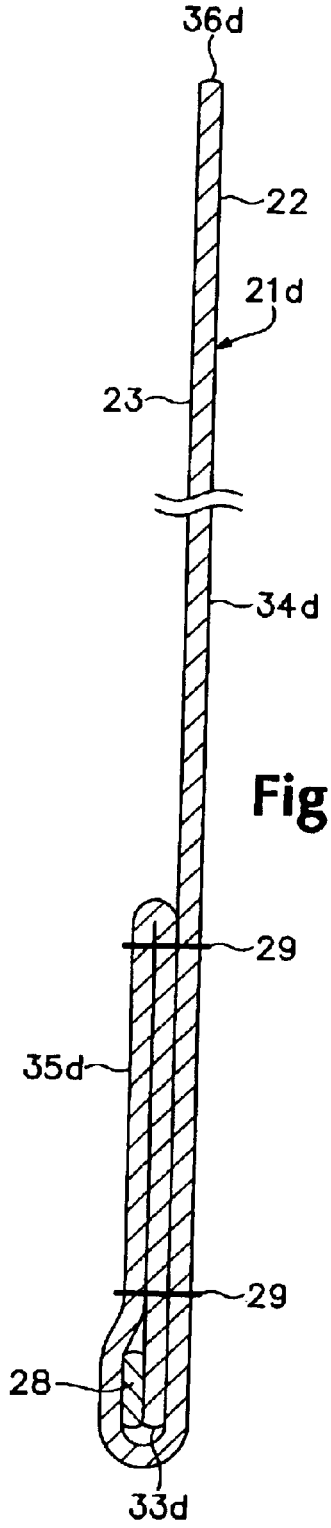
FIG. 15 is a cross-sectional view, as defined by line 15—15 in FIG. 14.

Once the various panels 21*a*–21*f* are secured together and element 28 is secured adjacent to base edges 33*c*–33*f*, base portions 35*c*–35*f* may be folded to begin the formation of band 24, as depicted in FIG. 13. By folding band portions 35*c*–35*f* one additional time, the configuration of FIG. 14 is achieved. Accordingly, a portion of band 24 may be formed by merely folding band portions 35*c*–35*f*. In this configuration, element 28 is positioned within band 24 and adjacent to a lower portion of band 24, as depicted in the cross-section of FIG. 15. Note, however, that a portion of band 24 corresponding with front panels 21*a* and 21*b* has not yet been formed.

Following the partial formation of band 24, stitching 29 may be added in various locations to prevent band 24 from unfolding. Furthermore, first side edge 31*a* may be secured to second side edge 32*f*, and the portions of second side edges 32*a*–32*f* that are adjacent to covering portions 34*a*–34*f*, respectively, may be secured to the portions of first side edges 31*a*–31*f* that are adjacent to covering portions 34*a*–34*f*, respectively. This forms the generally hemispherical shape of crown portion 20. Seam tape 25 may then be secured to interior surface 23 to mask the seams between the various panels 21*a*–21*f*. Apertures 26 may be formed, and button 27 may be added to the area of points 36*a*–36*f*, thereby substantially completing the manufacture of crown portion 20.

Following the completion of crown portion 20, or concurrent with the formation of crown portion 20, visor portion 30 may be secured to band portions 35*a* and 35*b*. Accordingly, the significantly reduced size of band portions 35*a* and 35*b* may retain sufficient material to attach visor 30. An additional element of material may then be secured to crown portion 20 to form the remaining portion of band 24 that extends under front panels 21*a* and 21*b*.

Element 28 provides additional resistance to stretching in crown portion 20. Accordingly, the specific angle selected for indentation angles may be slightly reduced to account for the additional stretch resistance that is provided by element 28. Furthermore, element 28 may be utilized to ensure that any loss in stretch during the manufacturing process, due to heat setting, for example, is maintained.

Figure 16:
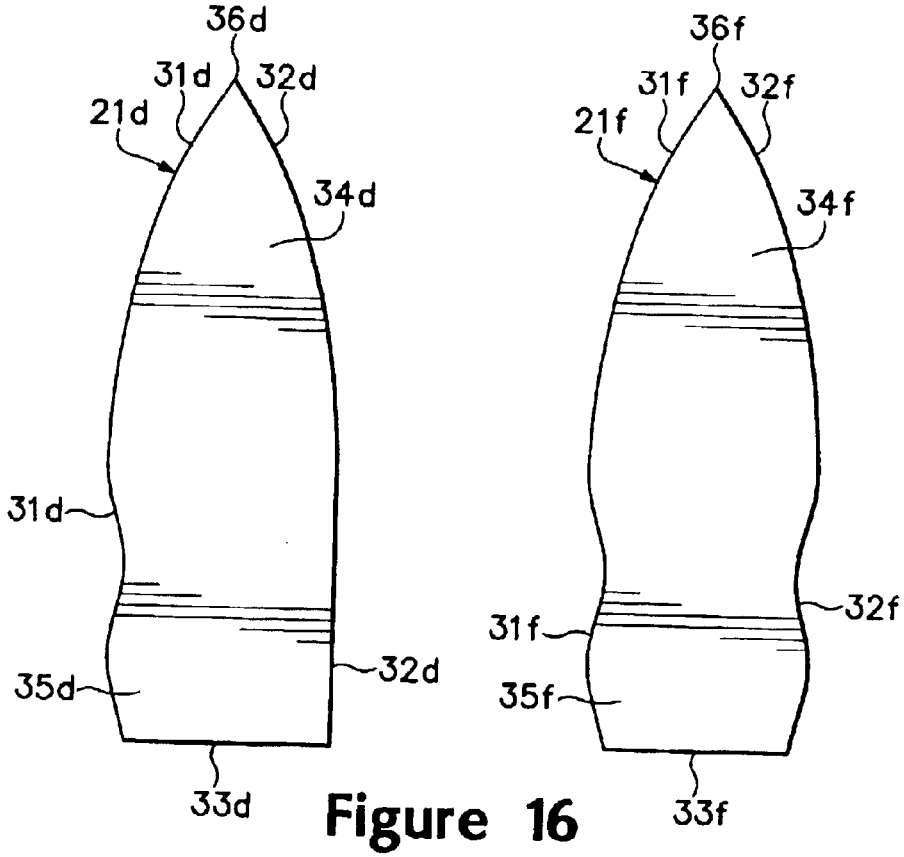
FIG. 16 is a plan view of yet another alternate panel configuration.

As discussed above and depicted in the figures, the various indentations formed in panels 21*c*–21*f* are formed from straight segments of the various edges that extend into the panels 21*c*–21*f*. In an alternate embodiment, however, the indentations may be formed from non-linear portions of the various edges. That is, the indentations may have a generally curved configuration, as depicted in FIG. 16 with respect to panels 21*d* and 21*f*.

Based upon the above discussion, headwear 10 may be engineered to have a desired degree of stretch by varying the indentation angles in the various panels 21*c*–21*f* that form crown portion 20. In addition, the materials selected for panels 21*a*–21*f*, the presence or absence of element 28, and other factors may be utilized in conjunction with various indentation angles to design headwear 10 to have a particular fit or comfort level.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An article of headwear having an adjustable configuration, the article of headwear comprising a plurality of panels that form a covering for a head and a band for extending around at least a portion of the head, the band being located adjacent an interior surface of the covering, the plurality of panels including a first panel with a first indentation that extends into an interior of the first panel, the first indentation being positioned in a portion of the first panel that forms the band, and an edge that forms the first indentation being secured to a second panel to stretch the first panel in an area of the first indentation.

2. The article of headwear recited in claim 1, wherein the second panel includes a second indentation that extends into an interior of the second panel, the second indentation being positioned in a portion of the second panel that forms the band, and an edge that forms the second indentation being secured to the edge that forms the first indentation to stretch the second panel in an area of the second indentation.

3. The article of headwear recited in claim 2, wherein the first panel includes a third indentation, an edge that forms the third indentation being secured to a third panel to stretch the first panel in an area of the third indentation.

4. The article of headwear recited in claim 3, wherein the second panel includes a fourth indentation, an edge that forms the fourth indentation being secured to a fourth panel to stretch the second panel in an area of the fourth indentation.

5. The article of headwear recited in claim 2, wherein the first panel has a first base edge that is different from the edge that forms the first indentation, and the second panel has a second base edge that is different from the edge that forms the second indention, and the article of headwear further includes an elastic element that is secured proximal to the first base edge and the second base edge.

6. The article of headwear recited in claim 5, wherein the elastic element is positioned within the band.

7. The article of headwear recited in claim 5, wherein the elastic element is positioned to extend around at least a portion of the head.

8. The article of headwear recited in claim 5, wherein the elastic element has a width of approximately 3 millimeters.

9. The article of headwear recited in claim 5, wherein the elastic element has a width less then 8 millimeters.

10. The article of headwear recited in claim 1, wherein the article of headwear is a baseball cap.

11. The article of headwear recited in claim 10, wherein the baseball cap includes a visor that is secured to the plurality of panels.

12. The article of headwear recited in claim 1, wherein the first panel and the second panel are formed of a stretchable material.

13. The article of headwear recited in claim 1, wherein an area of the first panel that forms the band is folded at least once to form the band.

14. The article of headwear recited in claim 1, wherein an area of the first panel that forms the band is folded twice to form the band.

15. The article of headwear recited in claim 1, wherein the edge that forms the first indentation has at least one straight segment that extends into the first panel.

16. The article of headwear recited in claim 15, wherein the at least one straight segment extends into the first panel at an angle of approximately 9.5 degrees.

17. The article of headwear recited in claim 15, wherein the at least one straight segment extends into the first panel at an angle that is in a range of 9.5 degrees and 13 degrees.

18. An article of headwear having an adjustable configuration, the article of headwear comprising:

a pair of first panels, each first panel having a first covering portion and a first band portion;

a pair of second panels formed of a stretchable material, each second panel having a second covering portion and a second band portion, the second band portion of each second panel having an edge that forms a second indentation extending into the second band portion; and a pair of third panels formed of the stretchable material, each third panel having a third covering portion and a third band portion, the third band portion of each third panel having a pair of opposite edges that each form third indentations extending into the third band portion, wherein the panels are secured together to form a covering from the covering portions, and the panels are secured together to stretch the band portions in areas of the second and third indentations, at least the second band portions and the third band portions being folded to form a band that is positioned adjacent an interior surface of the covering and extends around at least a portion of the covering.

19. The article of headwear recited in claim 18, wherein the article of headwear is a baseball cap.

20. The article of headwear recited in claim 19, wherein the baseball cap includes a visor that is secured to the pair of first panels.

21. The article of headwear recited in claim 18, wherein the pair of first panels are formed of the stretchable material.

22. The article of headwear recited in claim 18, wherein the second band portions and the third band portions are folded at least once to form the band.

23. The article of headwear recited in claim 18, wherein the second band portions and the third band portions are folded twice to form the band.

24. The article of headwear recited in claim 18, wherein the edges that form the second and third indentations have at least one straight segment.

25. The article of headwear recited in claim 24, wherein the at least one straight segment forms an angle of approximately 9.5 degrees.

26. The article of headwear recited in claim 24, wherein the at least one straight segment forms an angle that is in a range of 9.5 degrees and 13 degrees.

27. The article of headwear recited in claim 18, wherein an elastic element is positioned within the band and secured to at least the second and third band portions.

28. The article of headwear recited in claim 27, wherein the elastic element is secured adjacent to base edges of the second and third band portions, the base edges being positioned opposite the second and third covering portions.

29. The article of headwear recited in claim 27, wherein the elastic element has a width less then 8 millimeters.

30. A method of manufacturing an article of headwear with an adjustable configuration, the method including steps of:

providing a first panel with a first covering portion and a first band portion;

forming a first indentation in an edge of the first band portion;

providing a second panel with a second covering portion and a second band portion;

stretching the first indentation in the edge of the first band portion;

securing the edge of the first band portion to an edge of the second band portion; and folding the first band portion and the second band portion to form a band of the headwear.

31. The method recited in claim 30, wherein the step of providing the first panel includes forming the first panel from a stretchable textile material.

32. The method recited in claim 30, wherein the step of forming the first indentation includes extending at least one straight segment of the edge of the first band portion into the first band portion.

33. The method recited in claim 32, wherein the step of forming the first indentation includes extending the at least one straight segment into the first band portion at an angle of approximately 9.5 degrees.

34. The method recited in claim 32, wherein the step of forming the first indentation includes extending the at least one straight segment into the first band portion at an angle that is in a range of 9.5 degrees and 13 degrees.

35. The method recited in claim 30, wherein the step of providing the second panel includes forming a second indentation in the edge of the second band portion.

36. The method recited in claim 35, wherein the step of providing the second panel includes extending at least one straight segment of the edge of the second band portion into the second band portion.

37. The method recited in claim 35, wherein the step of stretching the first indentation includes also stretching the second indentation.

38. The method recited in claim 35, wherein the step of securing the edge of the first band portion includes securing the first indentation to the second indentation.

39. The method recited in claim 30, further including a step of securing an elastic element to base edges of the first band portion and the second band portion.

40. The method recited in claim 39, wherein the step of folding the first band portion and the second band portion includes positioning the elastic element within the band.

41. The method recited in claim 39, wherein the step of securing the elastic element includes selecting the elastic element to have a width of approximately 3 millimeters.

42. The method recited in claim 39, wherein the step of securing the elastic element includes selecting the elastic element to have a width less than 8 millimeters.

43. A method of manufacturing an article of headwear with an adjustable configuration, the method including steps of:

providing a plurality of panels, each panel having a covering portion and a band portion;

securing an elastic element to base edges of the band portions, the base edges being positioned opposite the covering portions;

securing edges of the plurality of panels together; and folding the band portions to form a band positioned adjacent an interior surface of the article of headwear and to position the elastic element within the band.

44. The method recited in claim 43, wherein the step of securing the elastic element includes selecting the elastic element to have a width of approximately 3 millimeters.

45. The method recited in claim 43, wherein the step of securing the elastic element includes selecting the elastic element to have a width less than 8 millimeters.

46. The method recited in claim 43, wherein the step of securing the elastic element includes utilizing overlocking to stitch the elastic element to the base edges.

47. The method recited in claim 43, further including a step of forming an indentation in at least one of the band portions.

48. The method recited in claim 47, wherein the step of securing edges includes stretching the indentation.

49. An article of headwear having an adjustable configuration, the article of headwear comprising:

a covering portion for extending over a head of a wearer; and a band extending around at least a portion of a lower edge of the covering portion, at least a portion of the band including an elastic material, the elastic material being in a stretched condition prior to placing the article of headwear upon the head.

50. The article of headwear recited in claim 49, wherein the band is formed of a plurality of sections of the stretchable material that are joined together, at least one of the sections having a stretch-inducing edge joined to a connecting edge of an adjacent section, the stretch-inducing edge having an indentation prior to being joined to the connecting edge, the indentation being stretched when the stretch-inducing edge is joined with the connecting edge to place the elastic material in the stretched condition.

51. The article of headwear recited in claim 49, wherein an elastic strip is secured to the band.

52. The article of headwear recited in claim 51, wherein the elastic strip has a width less then 8 millimeters.

53. The article of headwear recited in claim 51, wherein the elastic strip is positioned within the band.

54. The article of headwear recited in claim 49, wherein the article of headwear is a baseball cap.

* * * * *